US007195020B2

(12) United States Patent
Bird

(10) Patent No.: US 7,195,020 B2
(45) Date of Patent: Mar. 27, 2007

(54) HAIR CURLER ROLLER WITH RETAINING CLAMP AND IN PARTICULAR, FOR OVERNIGHT USE

(75) Inventor: Cheryl L. Bird, 2021 Roosevelt Blvd., Ypsilanti, MI (US) 48197

(73) Assignee: Cheryl L. Bird, Ypsilanti, MI (US)

( * ) Notice: Subject to any disclaimer, the term of this patent is extended or adjusted under 35 U.S.C. 154(b) by 0 days.

(21) Appl. No.: 10/933,665

(22) Filed: Sep. 3, 2004

(65) Prior Publication Data

US 2006/0048789 A1 Mar. 9, 2006

(51) Int. Cl.
*A45D 2/28* (2006.01)

(52) U.S. Cl. ..... 132/258

(58) Field of Classification Search ..... 132/222–226, 132/257–258, 248, 246, 251–252, 255, 262; D28/37

See application file for complete search history.

(56) References Cited

U.S. PATENT DOCUMENTS

| | | | | | |
|---|---|---|---|---|---|
| 2,657,694 | A * | 11/1953 | Reed et al. | ..... | 132/259 |
| 3,200,826 | A * | 8/1965 | Solomon | ..... | 132/258 |
| 3,250,281 | A * | 5/1966 | Gresham et al. | ..... | 132/258 |
| 3,340,880 | A * | 9/1967 | Gresham et al. | ..... | 132/260 |
| 3,653,391 | A | 4/1972 | Andrews | ..... | 132/40 |
| 3,960,157 | A | 6/1976 | Andrews | ..... | 132/40 |
| 4,056,109 | A * | 11/1977 | Takai | ..... | 132/253 |
| 4,630,622 | A * | 12/1986 | Foreman | ..... | 132/253 |
| 5,285,800 | A | 2/1994 | Powers-McCarthy | ..... | 132/210 |
| 6,273,096 | B1 | 8/2001 | Mbonisi | ..... | 132/258 |
| 6,283,128 | B1 | 9/2001 | Saxton | ..... | 132/246 |
| 6,363,945 | B1 | 4/2002 | Roberson | ..... | 132/255 |
| 2003/0136421 | A1 | 7/2003 | Trent | ..... | 132/258 |

* cited by examiner

*Primary Examiner*—Todd E. Manahan
*Assistant Examiner*—Rachel A. Running

(57) ABSTRACT

A hair curler roller including a hardened and substantially spool-shaped core. A foam outer layer is applied about an exterior surface associated with the core, said outer layer further including a smooth fabric satin covering. A clamp mechanism is engageably secured about an annular surface associated with the spool-shaped core, the clamp mechanism including inwardly directed and extending serrated edges. The clamp mechanism is manipulated between opened and closed positions, and such that the serrated edges biasingly sandwich a user's hair wound about the outer layer.

10 Claims, 7 Drawing Sheets

HAIR CURLER ROLLER WITH RETAINING CLAMP AND IN PARTICULAR, FOR OVERNIGHT USE

BACKGROUND OF THE INVENTION

1. Field of the Invention

The present invention relates generally to hair curler rollers. Specifically, the present invention discloses a hair curler roller of improved design and which incorporates the features of a hardened plastic core combined with an outer foamable and satin covered material, and about which is engageable a clamp exhibiting inwardly directed and serrated teeth. In use, the curler roller is capable of being comfortably worn overnight, to provide a smooth curled appearance, and to prevent hair breakage.

2. Description of the Prior Art

The prior art is well documented with examples of hair curler rollers. The main purpose of such rollers is to provide a stylish curl without the incidence of frizzing, kinking and breakage of hair ends.

U.S. Pat. No. 6,363,945, issued to Roberson, discloses a hair roller cover with sewn-in silk, satin nylon or spandex flap slidable onto a standard hair roller. The hair roller cover includes four sections of fabric sewn together to construct a cylindrically-shaped cover, with a flap sewn into either side of the seams of the cylindrical shape. The main professed purpose of the roller cover is to prevent frizzing, kinking and hair breakage of the ends of hair.

Patent Application Publication No. 2003/0136421 A1, to Trent, teaches a hair curler support constructed of a flexible, resilient foam material and enclosed by a fabric cover to prevent hair strands from becoming ensnared by the foam material. The support is configured as a foam roller which is mounted on a relatively rigid core with the core having a bail attached thereto that fits over the roller to secure hair to the roller. The cover is attached by drawstrings positioned at the end of the cover. Preferably, the cover is porous and is made of a material such as satin, silk, rayon or polyester but is not limited to such materials.

U.S. Pat. No. 6,283,128, issued to Saxton, teaches a hair roller of multi-layer construction and in which all layers are soft and comfortable to allow the user to wear the hair rollers during sleeping. The hair roller includes an inner cellular foam layer, a compressible intermediate layer made of d-suede or velvet, and an outer layer made of satin or silk. The roller may also have a solid core. Chenille cord securing members extend from opposite ends of the cylindrical roller body to allow securing of the hair roller in place after a strand of hair has been wound on the roller body.

U.S. Pat. No. 6,273,096, issued to Mbonisi, teaches a hair roller having a smooth outer surface and a resilient central core. A hair clip is coupled to the central core for substantially holding the hair wrapped around the central core.

Finally, U.S. Pat. No. 5,285,800, issued to Powers-McCarthy, teaches a permanent wave apparatus and process for curling hair and exhibiting a perm roller having a cylindrical outer surface with four equally-spaced longitudinal rows of outwardly projecting teeth positioned therearound. As the hair strands are wrapped around the roller, the rows of teeth act to provide additional compression of the hair by pressing it more firmly together between adjacent teeth with each rotation of the roller. Plastic slide clips serve to secure the first roller used to wrap a given section of hair to the scalp to provide increased volume of the resulting curl at the scalp, the plastic roller clips also being used to secure subsequently wrapped rollers in that section of hair to each other.

SUMMARY OF THE PRESENT INVENTION

The present invention discloses a hair curler roller incorporating the features of a hardened plastic core combined with an outer foamable and satin covered material. As previously described, a clamp exhibiting inwardly directed and serrated teeth is pivotably mounted about the spindle. In use, the curler roller is capable of being comfortably worn overnight, to provide a smooth curled appearance, and to prevent hair breakage.

The hair curler roller includes a hardened and substantially spool-shaped core, this typically being constructed of a durable plastic. A foam outer layer is applied about an exterior surface associated with the core, said outer layer including, in a preferred application, a smooth fabric satin or other suitable and smooth covering.

A clamp mechanism is engageably secured about an annular surface associated with the spool-shaped core. The clamp mechanism includes first and second elongated side members, each exhibiting inwardly directed and extending serrated edges.

First and second cross members interconnect the serrated edges at opposite ends thereof. The first cross member is pivotally mounted to a first end face associated with the spool-shaped core, whereas the second cross member is releasably and biasingly seated to the second end face.

The clamp mechanism is manipulated between opened and closed positions, and such that the serrated edges biasingly sandwich a user's hair wound about the outer layer. In overnight use, the hair curler roller gives the impression of sleeping on foam but, also because of the hard core insert, provides the necessary firmness which alleviates unwanted twisted ends associated with traditional foam/sponge rollers. In addition, the satin cover prevents breakage of the hair. The inwardly serrated teeth are further configured to be sufficiently small and such that the user suffers no discomfort from the roller during overnight use.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to FIGS. 1–4 in combination, a series of perspective views of a hair curler roller arrangement are illustrated at 10 according to the invention. As described previously, the curler roller is capable of being comfortably worn overnight, in order to provide a smooth curled appearance, and to prevent hair breakage.

The roller includes a hardened and substantially spool-shaped inner core. As best shown in the successive illustrations of FIGS. 11A–11F, a series of side and end views are shown of representative shaped foam coverings for use with differently sized spindles, each of which are typically constructed of an appropriate foamable material.

Figure 11D:
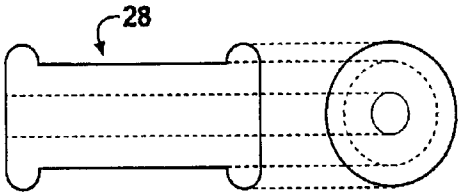
FIG. 11D illustrates side and end views of a foamable sleeve covering for use with a large sized spindle.
Figure 11E:
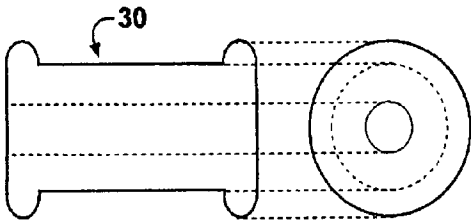
FIG. 11E illustrates side and end views of a foamable sleeve covering for use with a bouffant sized spindle.
Figure 11F:
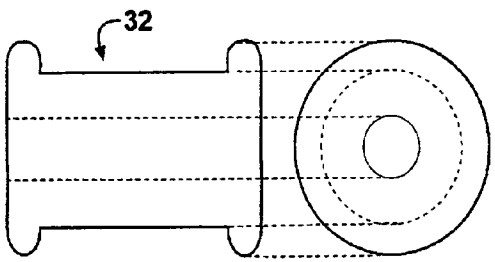
FIG. 11F illustrates side and end views of a foamable sleeve covering for use with an extra large sized spindle.
Figure 11A:
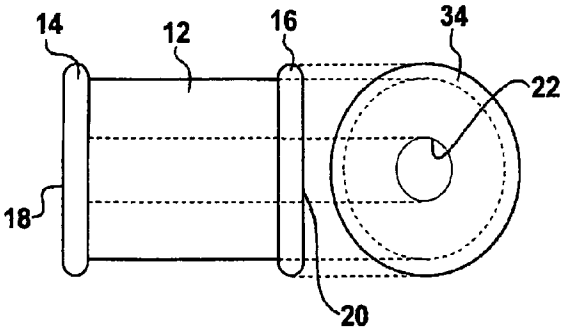
FIG. 11A illustrates side and end views representative of a given sized hardened spindle with a foamable sleeve covering according to the invention.
Figure 11B:
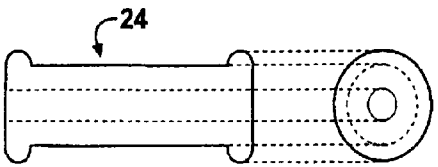
FIG. 11B illustrates side and end views of a foamable sleeve covering for use with a small sized spindle.
Figure 11C:
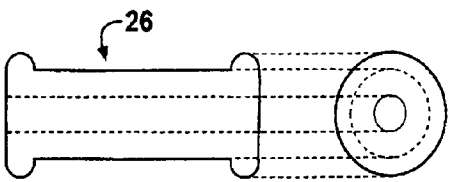
FIG. 11C illustrates side and end views of a foamable sleeve covering for use with a medium sized spindle.

In particular, and referencing first FIG. 11A, the foam cover replicates a shaped core with an annular outer surface 12 and first 14 and second 16 protuberant ends which exhibiting associated end faces 18 and 20. As also shown, a central aperture 22 extends through a center of the foam cover and core. As further exhibited at 24, 26, 28, 30 and 32, in corresponding fashion to FIGS. 11B–11F, additional foam spindle coverings are illustrated, each of substantially the same overall configuration, and correspond to small 24, medium 26, large 28, bouffant 30 and extra large 32 rollers.

Applied over the outer annular surface of each spindle (see again as shown at 12 in FIG. 11A) is a foam outer layer, see for example at 34 in FIG. 11A. In a preferred embodiment, the foam outer layer includes a satin (or other suitable fabric) covering.

Figure 9:
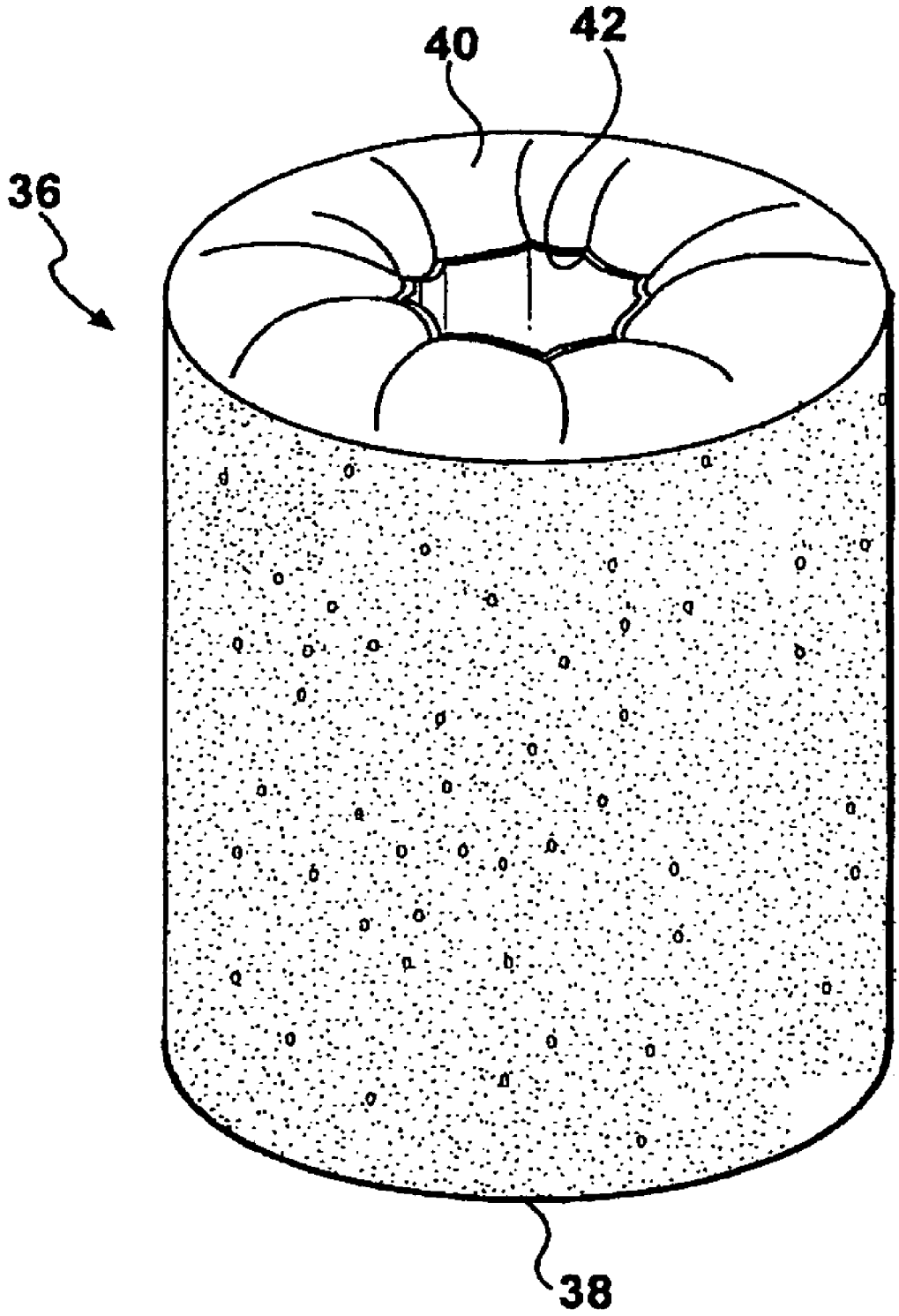
FIG. 9 is a sectional illustration of a satin covering sleeve exhibiting an elastic tie band for use with a hardened spindle core.

Referring to FIG. 9, an alternative variant 36 of foam outer covering teaches an attachable sleeve, in an overall shape replicating that of a suitably sized inner core and again including an inner foam layer about which is covered a satin or other suitable outer fabric covering. A first end face 38 of the covering is closed, whereas a second end face 40 exhibits an elastic band to facilitate applying the covering 36 over the spindle.

Figure 5:
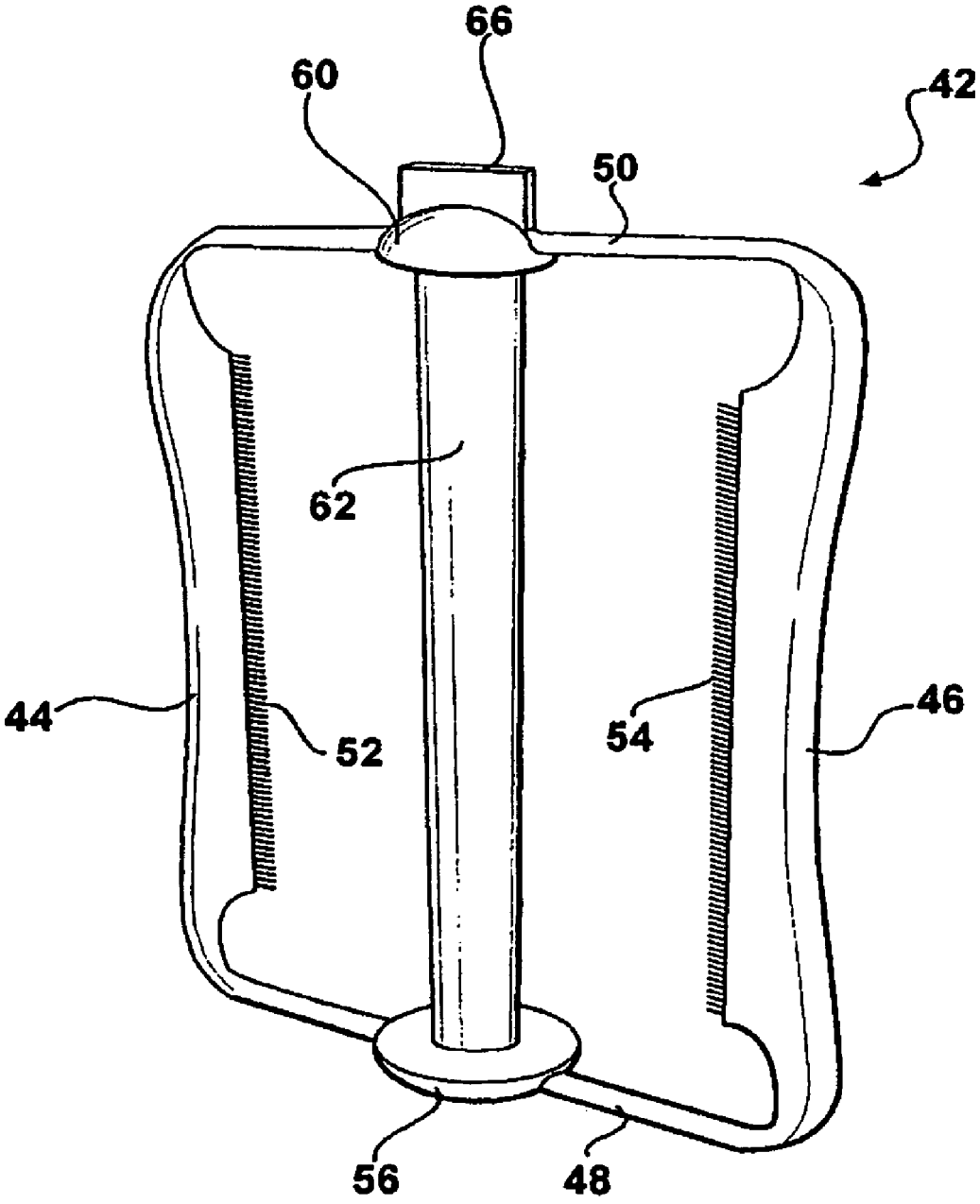
FIG. 5 is a sectional view of the clamp mechanism separated from the hair curler roller spindle.

Referring now to FIG. 5, a sectional view of a clamp mechanism is illustrated at 42 and separated from the hair curler roller spindle. The clamp mechanism 42 includes first 44 and second 46 elongate extending sides which are interconnected by first 48 and second 50 cross members at opposite ends thereof. The elongated sides 44 and 46 of the clamp 42 include arcuate extending outer edges and corresponding, substantially planar and inwardly facing edges, these further exhibiting serrated (teeth like) projections (see further at 52 and 54 for sides 44 and 46, respectively). As will be further subsequently described, when mounted over a suitable shaped spindle with outer foam layer, the serrated projections sandwich any number of wraps of human hair wound about the spindle and foam layer and in such a fashion as to minimize discomfort to the wearer (such as during overnight use) while securably holding the roller in place.

Figure 2:
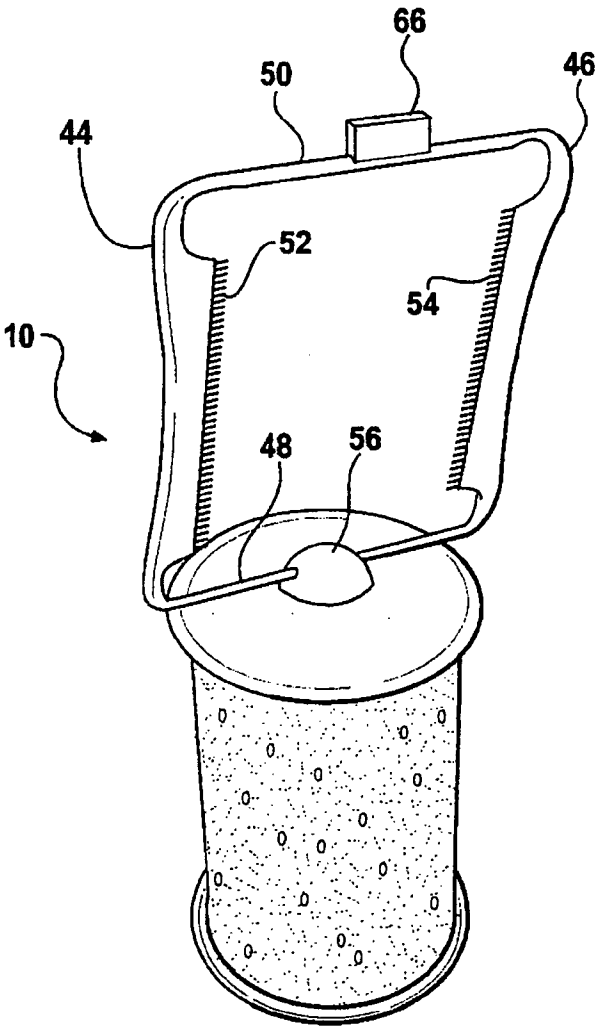
FIG. 2 is a further perspective view of the hair curler roller of FIG. 1 and further showing a pivotally associated clamp in a disengaged position.
Figure 1:
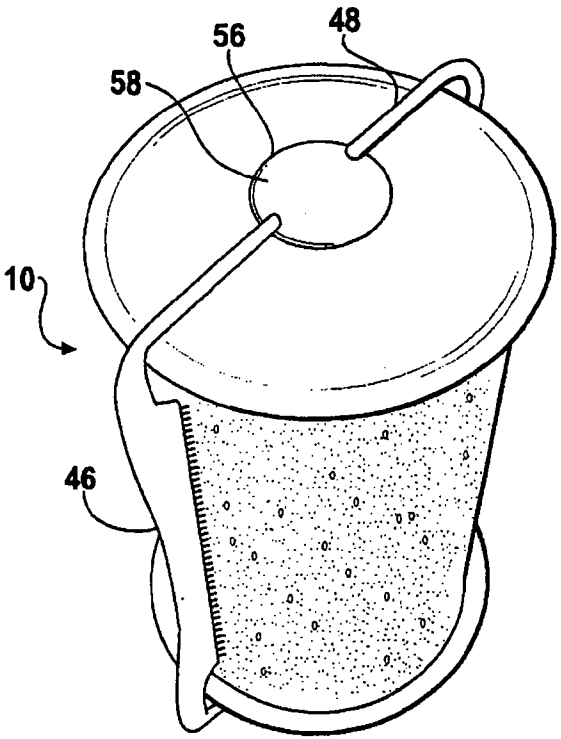
FIG. 1 is a perspective view of the hair curler roller according to the invention.
Figure 4:
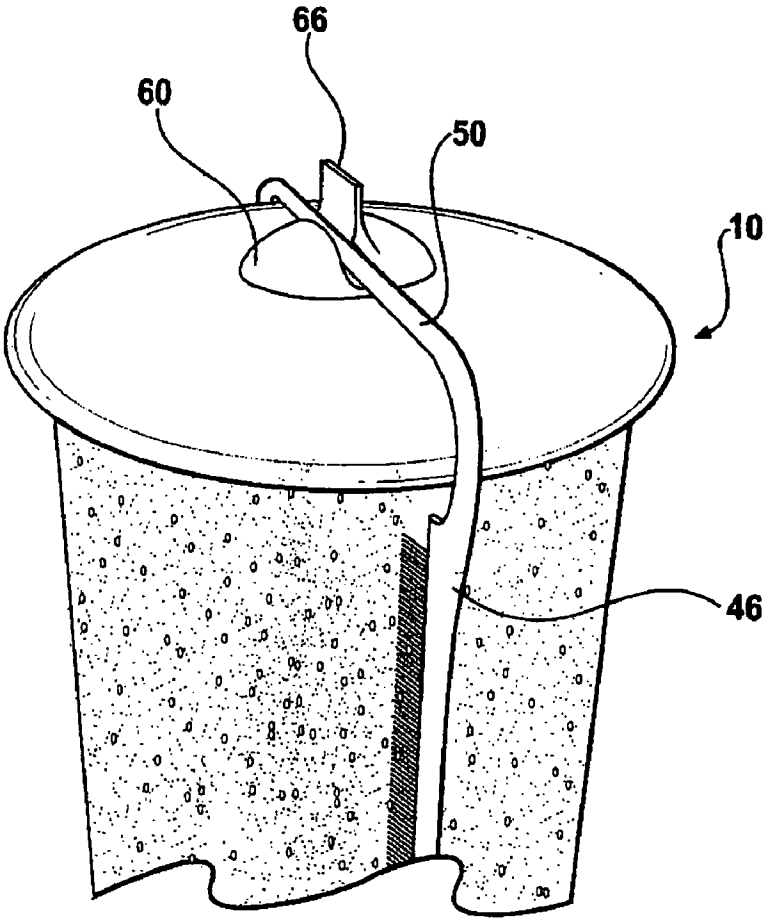
FIG. 4 is a radially rotated and enlarged sectional illustration of the hair curler roller of FIG. 3 and illustrating from another angle the manner of engagement of the clamp to the associated end face of the roller spindle.
Figure 3:
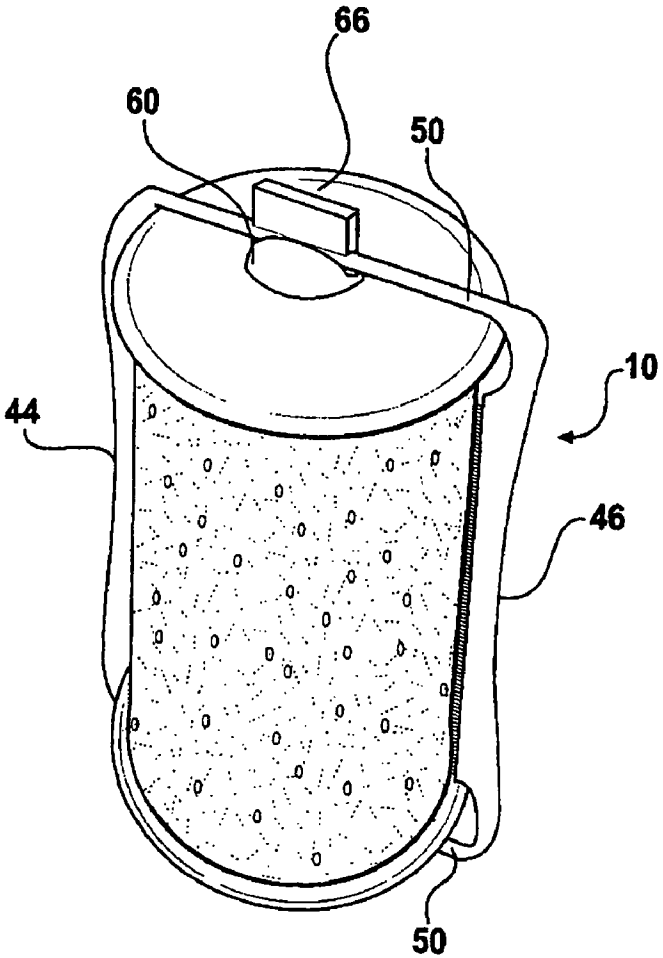
FIG. 3 is a reversed perspective view of the hair curler roller shown in FIG. 3 and illustrating the snap-engaging end of the clamp to the curler roller spindle.
Figure 7B:
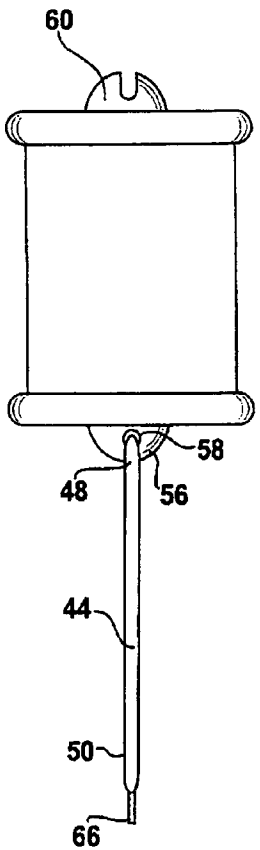
FIG. 7B is a rotated plan illustration of the hair curler roller of FIG. 7A.
Figure 7A:
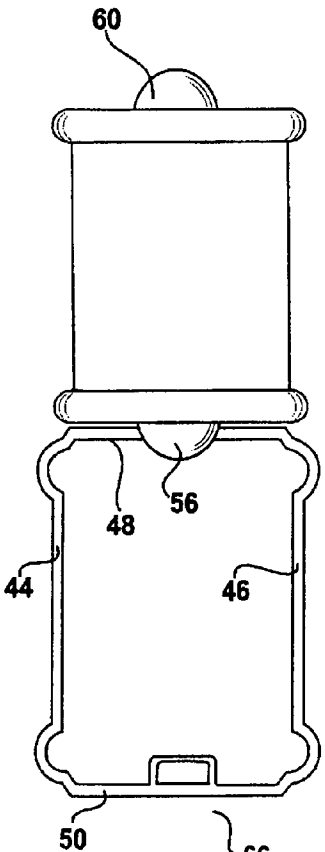
FIG. 7A is a plan view of the hair curler roller of FIG. 6A in an opened position.
Figure 6B:
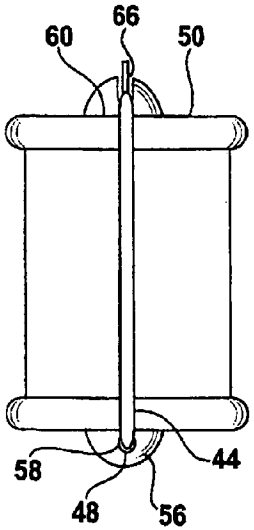
FIG. 6B is a rotated plan illustration of the hair curler roller of FIG. 6A.
Figure 6A:
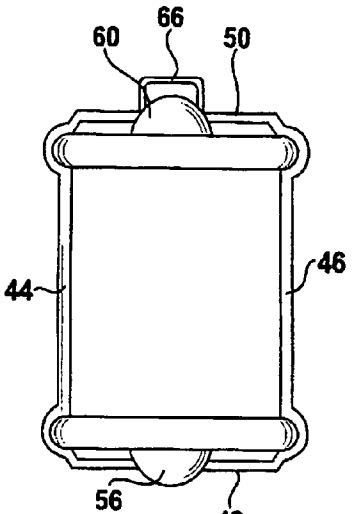
FIG. 6A is a plan view of a hair curler roller of a further embodiment in a closed position.

As also shown in FIGS. 1–4, 6A–6B, and 7A–7B the first cross member 48 pivotally secures to a first selected end face of the spool-shaped core, such as upon which is formed a first embossment 56 with a sideways extending slit 58 (see further FIGS. 1, 6B and 7B). The cross member 48 seats within the slit 58 formed in the embossment 56 in a pivotal and, generally, permanent fashion. The sides 44' and 46' in FIGS. 6A, 6B, 7A and 7B do not exhibit inwardly serrated projections, as in the embodiment of FIGS. 1–5, however it is envisioned that they may include other forms of biasing to firmly restrain and sandwich the wound hair wraps about the foam covering and inner core. Such may include resilient and biasing inner edges associated with the sides 44' and 46'.

The second cross member 50 biasingly engages against the other selected end face of the spindle in a closed position and such that it is releasably engaged to a second embossment 60. Typically, a central shaft 62 (again FIG. 5) extends between the first 48 and second 50 cross members, and associated embossments 56 and 58, such in particular that the shaft is adapted to be inserted through a corresponding aperture defined in lengthwise extending fashion within the spool-shaped core (see again for example at 22 in FIG. 11).

Figure 8:
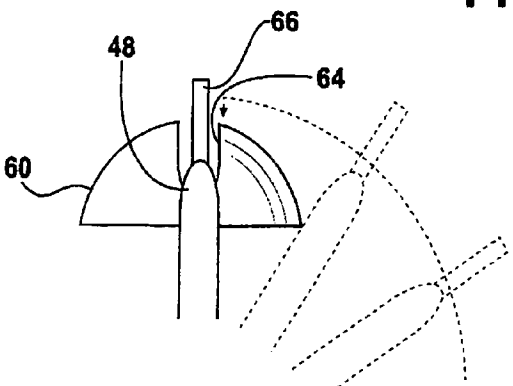
FIG. 8 is a partial illustration of the clamp mechanism.

As best shown in FIG. 8, the second cross member 48 biasingly and releasably seats within an aperture 64 defined in the second embossment 60. This is due in part to the material construction of the side members 44 and 46 and associated cross members 48 and 50 being constructed of a pliable plastic or other suitable material. The second cross member 48 further includes a catch portion 66 extending in an outward direction and which provides a gripping surface for biasingly removing the associated cross member 48 from the aperture 64 defined in the embossment 60. In this fashion, and referencing again the views of FIGS. 1–4, it is evident as to how the clamp mechanism is selectively opened and closed in order to secure about a desired number of wraps of a user's hair.

Figure 10A:
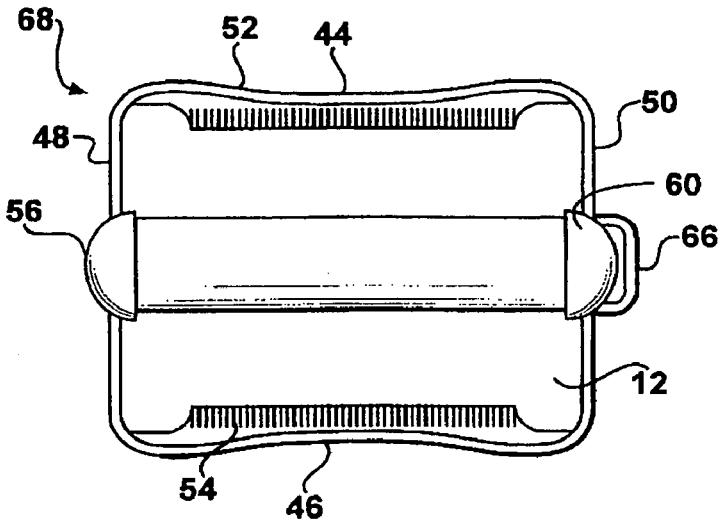
FIG. 10A is a first cutaway plan illustration of an extra large hair curler roller according to the invention.
Figure 10B:
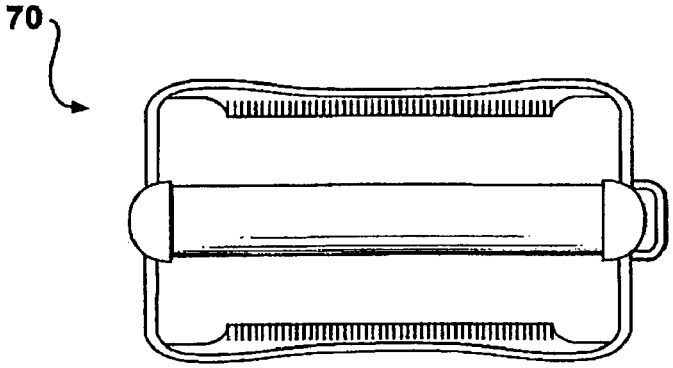
FIG. 10B is a second cutaway plan illustration of a medium hair curler roller.
Figure 10C:
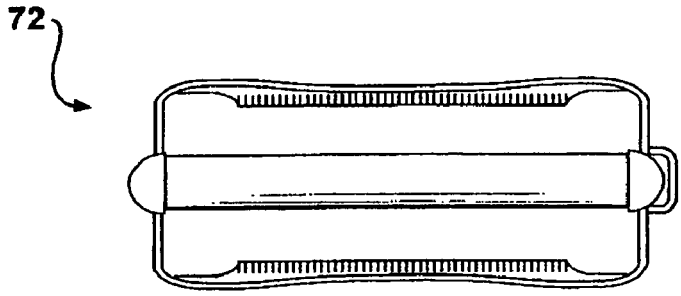
FIG. 10C is a third cutaway plan illustration of a small hair curler roller.

Referring finally to FIGS. 10A–10C, a series of three cutaway plan illustrations are generally shown of an extra large hair curler roller 68, medium hair curler roller 70, and small hair curler roller 72 according to the invention. In each instance, the inwardly serrated (teethed) edges are pivotally engaged to grip the windings of human hair (not shown) and to hold the hair in place against the satin covered foam layer and about the hardened inner plastic core. In this fashion, the roller is capable of being employed to provide tighter or looser curls, depending upon the commensurate tightness of the hair windings.

Having described my invention, other and additional preferred embodiments will become apparent to those skilled in the art to which it pertains, without deviating from the scope of the appended claims.

I claim:

1. A hair curler roller, comprising:

a hardened and substantially spool-shaped core;

a foam outer layer applied about an exterior surface associated with said core;

a clamp mechanism pivotally associated with said spool-shaped core, said clamp mechanism including first and second elongate extending and serrated edges, said clamp mechanism further comprising first and second cross members interconnecting said serrated edges at opposite ends thereof;

said clamp mechanism further comprising a central shaft extending between said first and second cross members, said shaft adapted to insert through a corresponding aperture defined in lengthwise extending fashion within said spool-shaped core; and said clamp mechanism being manipulated between opened and closed positions and such that said serrated edges biasingly sandwich at least one roll of a user's hair wound about the outer layer.

2. The hair curler roller as described in claim 1, said inner core further comprising a plastic body.

3. The hair curler roller as described in claim 1, said outer layer further comprising a satin covering.

4. The hair curler roller as described in claim 1, further comprising an elastic band associated with an end face of said outer layer.

5. The hair curler roller as described in claim 4, said hair curler roller exhibiting a specified shape and size, said foam outer layer being manipulated over a selected end face of said spool-shaped cord, said elastic band retaining said outer layer upon said core.

6. The hair curler roller as described in claim 1, said first cross member pivotally securing to a first selected end face of said spool-shaped core, said second cross member biasingly engaging against the other selected end face in a closed position.

7. The hair curler roller as described in claim 6, further comprising a smooth-faced embossment extending from said first core end face, said first cross member permanently and pivotally seating within a slit extending across said embossment and in parallel direction to said end face.

8. The hair curler roller as described in claim 7, further comprising a second smooth-faced embossment extending from said second core end face, said second cross member biasingly and releasably seating within an aperture defined in said second embossment.

9. The hair curler roller as described in claim 8, further comprising a catch portion extending from said second cross member, in a direction opposite said second embossment.

10. The hair curler roller as described in claim 1, said hair curler roller exhibiting a specified shape and size, said elongate extending and serrated edges extending in inwardly and substantially level fashion, corresponding outer surfaces extending in arcuate fashion.

* * * * *